US007389885B2

(12) United States Patent
Masanek, Jr.

(10) Patent No.: US 7,389,885 B2
(45) Date of Patent: Jun. 24, 2008

(54) HANGER WITH RATCHETING SLIDING-JAW CLAMPS

(75) Inventor: Frederick W. Masanek, Jr., Barrington, IL (US)

(73) Assignee: David F. MacNeil, Hinsdale, IL (US)

( * ) Notice: Subject to any disclaimer, the term of this patent is extended or adjusted under 35 U.S.C. 154(b) by 0 days.

(21) Appl. No.: 11/693,949

(22) Filed: Mar. 30, 2007

(65) Prior Publication Data

US 2007/0145085 A1 Jun. 28, 2007

(51) Int. Cl.
*A47F 7/16* (2006.01)

(52) U.S. Cl. ..... 211/45; 211/113; 223/85; 223/DIG. 2

(58) Field of Classification Search ..... 223/85, 223/90, 91, 93, 96; 248/95, 215, 227.1, 339, 248/340, 692; 211/45, 85.3, 113, 118, 124; 24/522, 526, 527, 528, 542, 543
See application file for complete search history.

(56) References Cited

U.S. PATENT DOCUMENTS 3,558,038 A * 1/1971 Gelles et al. ..... 383/15
3,698,043 A * 10/1972 Batts ..... 223/87
3,698,607 A * 10/1972 Batts ..... 223/96
3,745,616 A * 7/1973 Batts ..... 24/543
3,841,478 A * 10/1974 Wells et al. ..... 206/495
D235,316 S * 6/1975 Wells ..... D9/457
4,054,234 A * 10/1977 Thomas ..... 223/91
4,236,280 A 12/1980 Kreiseder
D287,085 S * 12/1986 Leeds ..... D6/513
4,856,654 A * 8/1989 Reuben ..... 206/449
5,027,480 A * 7/1991 Hogarth ..... 24/543
D323,587 S * 2/1992 Primeau ..... D6/327
5,178,306 A * 1/1993 Petrou ..... 223/96
5,257,694 A * 11/1993 Wallach ..... 206/286
5,350,092 A * 9/1994 Hollis ..... 223/96
5,397,038 A * 3/1995 Hunt ..... 223/95
5,657,518 A * 8/1997 Hunt ..... 24/543

(Continued)

FOREIGN PATENT DOCUMENTS

DE 29907308 U * 7/1999

(Continued)

OTHER PUBLICATIONS

Photographs taken Apr. 2, 2007, All Weather Floor Mat Hanger manufactured for Hyundai.

(Continued)

*Primary Examiner*—Gary L. Welch
*Assistant Examiner*—Nathan E Durham
(74) *Attorney, Agent, or Firm*—Momkus McCluskey, LLC; Jefferson Perkins

(57) ABSTRACT

A hanger is injection-molded in one piece from a suitable polymer. At each of a plurality of gripping locations, a stationary gripping member and a mobile gripping member are provided, each of which preferably terminate in inwardly directed article supporting fingers. For each pair of gripping members, a fastening arm is provided on one of the members while a channel is provided in the other of the gripping members. A pawl engages with an array of teeth to fasten the gripping members together and to secure e.g. a pair of vehicle floor mats therebetween.

13 Claims, 8 Drawing Sheets

U.S. PATENT DOCUMENTS

| | | | | |
|---|---|---|---|---|
| 5,957,345 | A * | 9/1999 | Petrou et al. | 223/96 |
| 6,065,652 | A * | 5/2000 | Dooling-Sherman | 223/93 |
| 6,226,839 | B1 | 5/2001 | Sayegh | |
| D475,283 | S * | 6/2003 | Haboush | D9/415 |
| D519,157 | S * | 4/2006 | Balatti | D19/86 |
| D525,661 | S * | 7/2006 | Hussaini et al. | D20/43 |

FOREIGN PATENT DOCUMENTS

| | | | |
|---|---|---|---|
| GB | 2205488 A | * | 12/1988 |
| JP | 2005144012 A | * | 6/2005 |
| WO | WO9417706 | | 8/1994 |

OTHER PUBLICATIONS

British Patent Office, Search Report of GB Appln. GB0715041.0, Nov. 30, 2007.

* cited by examiner

HANGER WITH RATCHETING SLIDING-JAW CLAMPS

BACKGROUND OF THE INVENTION

Vehicle floor mats and like articles are conveniently displayed at a point of sale by being hung on hangers from a display rack. The floor mats can be fairly heavy, more so than most garments taking up the same space, are typically flat and are flexible. Hangers for suspending these floor mats therefore have to be substantial enough to indefinitely sustain their weight without failure, and must secure the suspended mats well enough that they don't become separated even when subjected to considerable shearing or torsional forces experienced during shipping or display.

It is to the manufacturer's commercial advantage if such hangers can be easily attached to the mats before they are shipped to distributors. Where made of plastic, such hangers should be easily injection-molded.

SUMMARY OF THE INVENTION

According to one aspect of the invention, an article hanger has a pair of gripping members or claws at each of one or more gripping locations. Each of the gripping members depends downwardly relative to a hanger body and at least one of them terminates at a lower end thereof with an article-supporting finger. A stationary one of the gripping members preferably is molded as a unit with the hanger body. A mobile one of the gripping members is initially molded with the hanger body but is detached prior to use. The mobile gripping member translates in a predetermined direction (such as the horizontal) toward the stationary gripping member to capture one or more articles therebetween for display or storage. A fastening arm extends from one of the mobile and stationary gripping members in a direction parallel to the direction of translation toward the other gripping member; the other gripping member is furnished with a channel or orifice for receiving this fastening arm. At least one detent, and more preferably an array of spaced-apart teeth, are provided on a surface of the fastening arm and these cooperate with a pawl associated with the other gripping member to fasten the mobile gripping member to the hanger body, thereby capturing at least one article therebetween.

Preferably, the hanger has two gripping locations and both the stationary and mobile gripping members for such locations are furnished with opposed, inwardly-directed article supporting fingers. Each pawl is conveniently provided with a tab or lever which, when pressed by a thumb or finger, rotates as a unit with the pawl, moving teeth of the pawl out of engagement with the teeth on the fastening arm, and permitting the withdrawal of the mobile gripping member from the hanger body.

One technical advantage of the present invention is its ease of molding and assembly to the suspended article in comparison with prior art designs. Another is the resistance of the invention to inadvertent detachment of the suspended article from the hanger during shipment or display.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
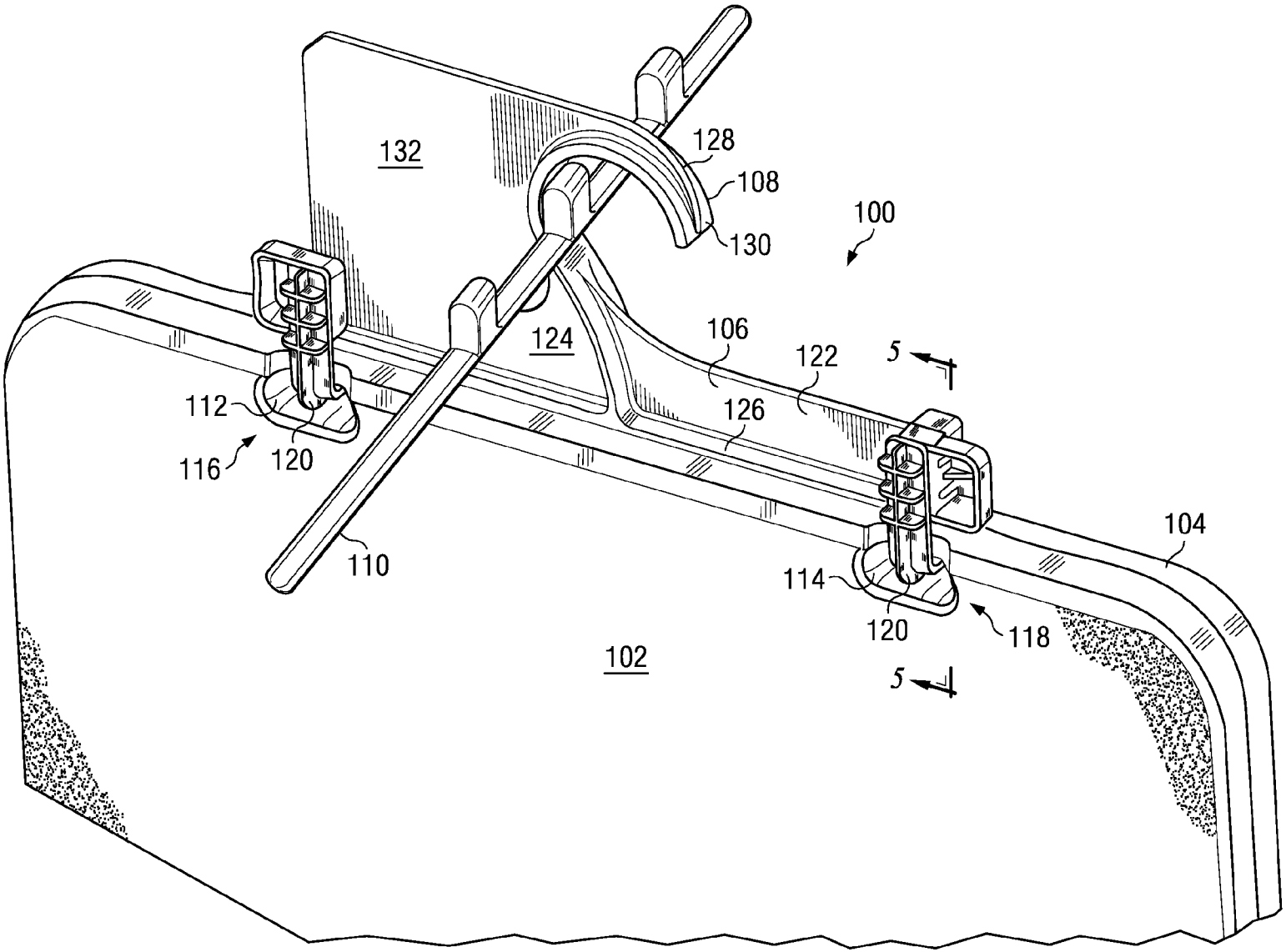
FIG. 1 is an isometric view of a commercial embodiment of the invention, shown suspending a pair of vehicle floor mats from a display rack arm.

A commercial embodiment 100 of a hanger according to the invention is shown in FIG. 1, as suspending a pair of vehicle floor mats 102, 104. The hanger 100 has a preferably injection-molded body 106 with an upstanding hook 108 from which the hanger and mats 100, 102, 104 can be suspended from a bar 110 of a display rack or the like. The illustrated embodiment is particularly designed to suspend vehicle floor mats 102, 104 in a back-to-back condition, where a pair of indentations 112, 114 near the upper margin of a front-facing floor mat 102 face frontward, and a similar pair of indentations (one such seen in FIG. 5) in floor mat 104 face rearwardly. The hanger 100 preferably grips the mats 102 and 104 at two spaced locations 116, 118 which are horizontally spaced from bar 110 in such a way that the mats 102 and 104 will hang squarely relative to the floor. In other embodiments of the invention, the hanger 100 could have more than two gripping locations, or only one of them, and could be provided to grip only a single mat, vehicle floor tray, or other relatively flat, flexible article, instead of a pair of them.

The hanger 100 further includes a number of mobile gripping members or claws 120 which in use are separate from and can be inserted into and withdrawn from the body 106. The hanger 100 is conveniently injection-molded from a plastic such as ABS. The hook 108 and crosspiece 122 of the body 106 are each formed of vertical and horizontal plates for strength and resistance to tension, shear and torsion forces. The crosspiece 122 has a plate 124 which in use is vertical, and a horizontal plate 126 formed at a lower margin thereof. The hook 108 is formed from a vertical plate 128 which is an integral extension of the vertical crosspiece plate 124, and joined to this a lateral plate 130 which also acts a surface contacting the display rack bar 110. The body 106 further has a flag 132 which is an extension of the crosspiece plate 124 and which further is joined to hook plate 128, providing lateral reinforcement thereto. The flag 132 provides an area to which a product label or other printed matter may be conveniently printed or adhered.

Figure 2:
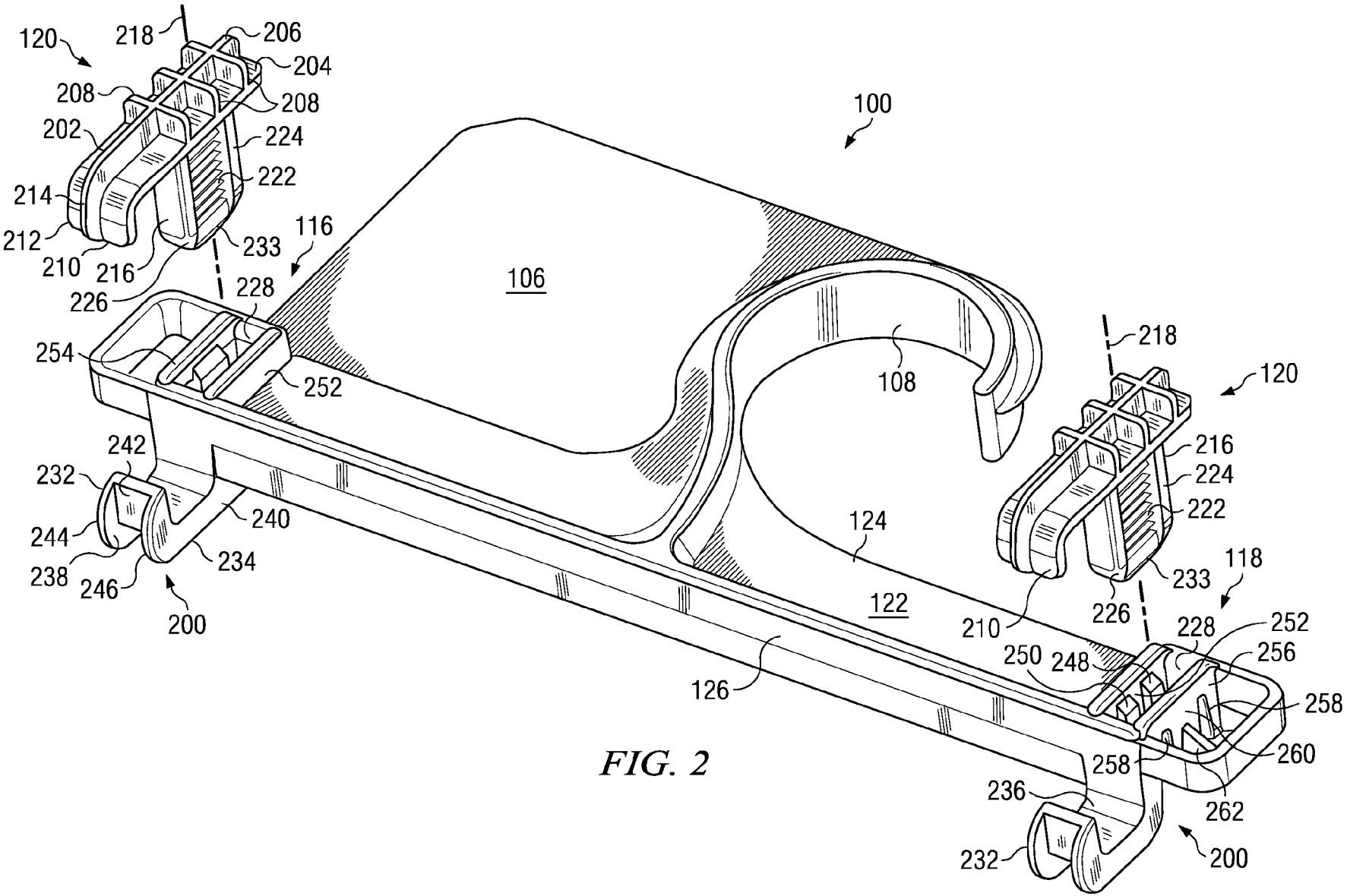
FIG. 2 is an exploded isometric view of the hanger shown in FIG. 1.
Figure 3:
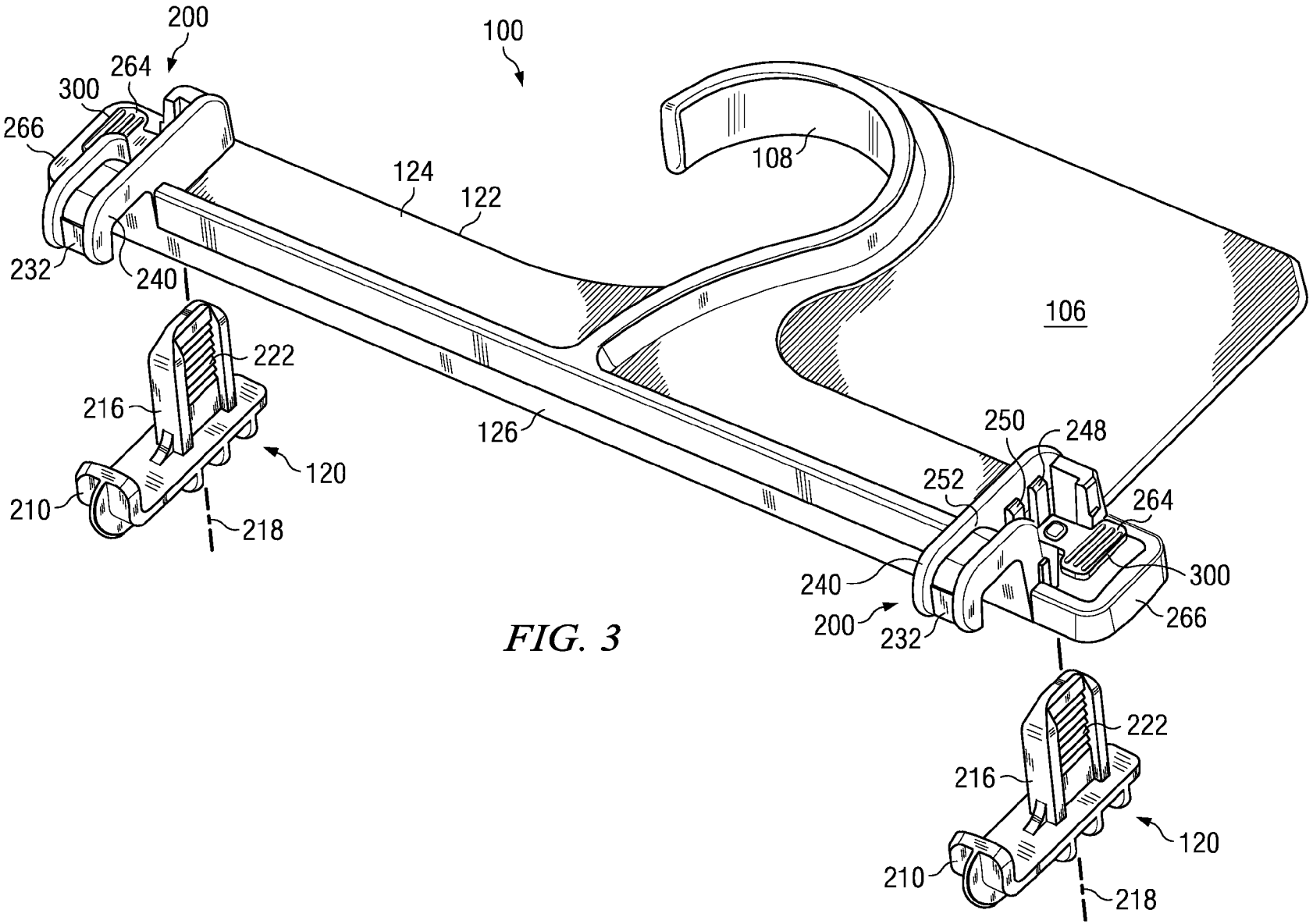
FIG. 3 is an exploded isometric view of the hanger shown in FIG. 1, taken from a reverse side.
Figure 4:
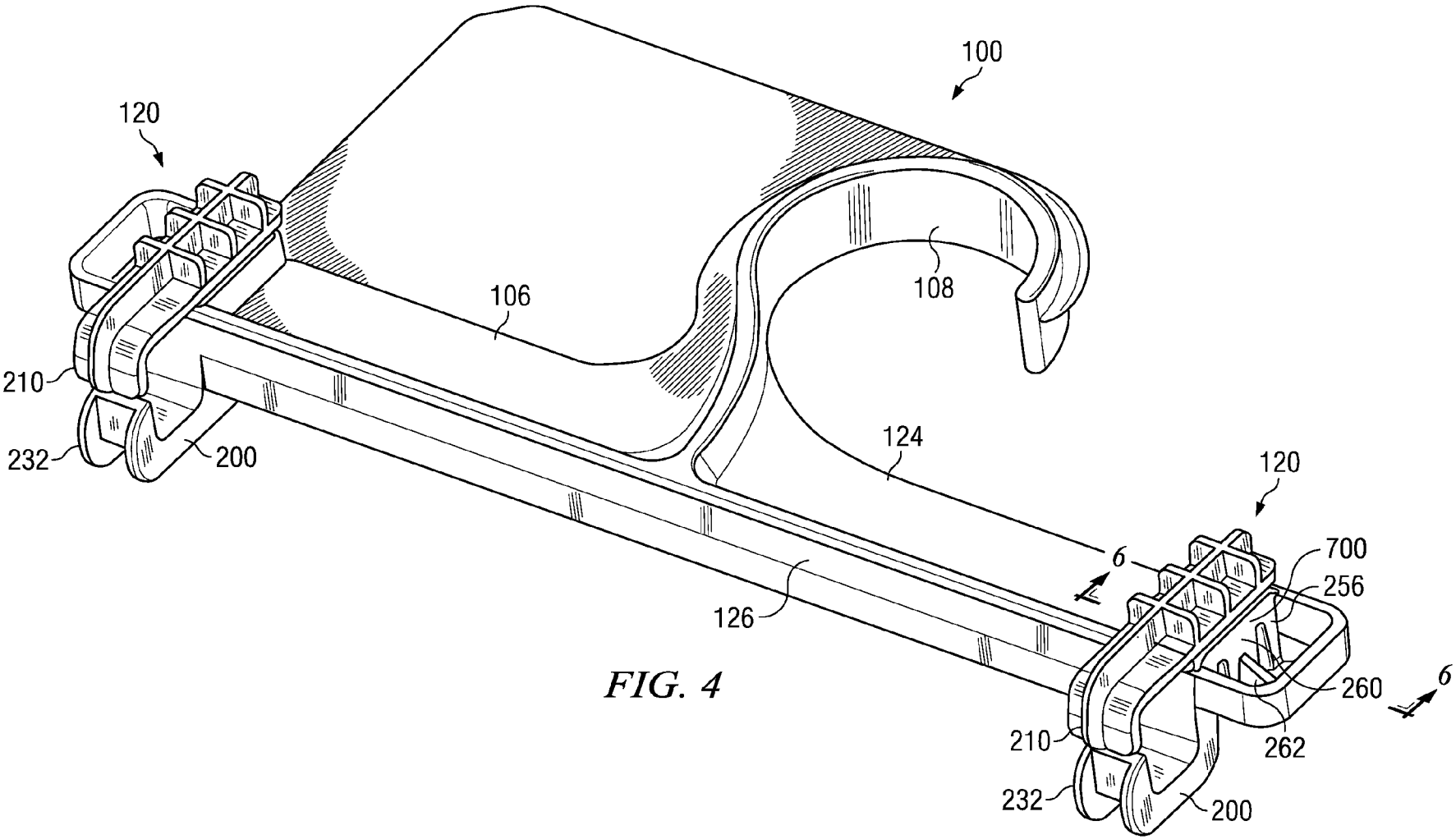
FIG. 4 is an isometric view of the hanger shown in FIG. 1, in a closed or fastening condition.

Referring to FIGS. 2-4, for each article gripping or supporting location 116, 118, a pair of gripping members is provided: a mobile gripping member 120 and a stationary gripping member or claw 200 which preferably is integrally formed as a portion of the body 106. Each mobile gripping member 120 has a body 202 comprising a vertical plate 204 and preferably a single central reinforcing plate 206 which extends from plate 204 at right angles thereto and in use is vertical. The body 202 may further have horizontally disposed plates 208, which are integrally formed with, stand at right angles to, and intersect vertical plates 204 and 206. Plates 208 provide additional surface area for contact by a thumb or finger of a user when the user desires to push a mobile gripping member 120 into a hanger channel 228 (described below). Plates 208 also add an element of reinforcement.

A lower end of the body 202 preferably has a horizontally and inwardly projecting process or article support finger 210. The support finger 210 is formed here as a curved extension 212 of plate 204 and is reinforced along its back with a curved extension 214 of plate 206. In certain other embodiments (not shown), as in those designed to support only one article, support finger 210 may be omitted.

In the illustrated embodiment the mobile gripping member 120 has a fastening arm 216 which extends in a direction of translation 218 relative to the body 106 of hanger 100; preferably, this direction 218 is horizontal and is at right angles to the plane to which hanger 100 (and supported articles 102, 104) is aligned. The fingers 210 also conform to this direction 218. Preferably the fastening arm 216 has a height (in a vertical direction) which is greater than its width, to provide an optimum capacity to support the weight of the article suspended on finger 210.

The fastening arm 216 has at least one, preferably vertically disposed face 220 on which is formed an array of ratcheting teeth 222. The teeth 222 are spaced from each other in direction 218 and may extend between a horizontally disposed top fastening arm rail 224 and a horizontally disposed bottom fastening arm rail 226. Fastening arm rails 224, 226 are used to guide the fastening arm 216 into a channel or orifice 228 in body 106 which is associated with a stationary gripping member 200. Preferably the fastening arm 216 terminates in a tapered nose 233 which aids in its insertion into channel 228.

Each stationary gripping member 200 is preferably integrally molded with hanger body 106 and downwardly depends therefrom. In the illustrated embodiment, a lower end of each stationary gripping member 200 terminates in an article support finger 232 which is disposed in parallel to direction 218 (here, horizontal). A body 234 of the stationary gripping member 200 is preferably formed by a vertical plate 236 and two reinforcing vertical plates 238, 240 which are disposed at right angles to plate 236, such that the body 234 has a "C" cross section. To form support finger 232, a curved extension 242 of the plate 236 is joined to curved extensions 244, 246 of the plates 238, 240. The plate extension 242 acts as a support surface on which the article 104 is suspended. In alternative embodiments, where only one article is being suspended, one of fingers 210, 232 may be omitted. In this embodiment, both fingers 210, 232 are included and are positioned to come together in opposition to each other, so as to capture two mats 102, 104 therebetween.

Each channel or arm-receiving orifice 228 preferably has a pair of elongate, parallel, spaced-apart glides 248, 250 which are formed in a channel back plate 252. Channel back plate 252 is preferably disposed in a vertical plane. Glides 248, 250 cooperate with fastening arm rails 224, 226 to better restrict the movement of mobile gripping member 120 to a direct translation down direction 218 into channel 228.

Channel 228 is also formed in part by a front plate 254, a back side 256 of which is visible in FIG. 2. In fastening the articles 102, 104 to the hanger 100, the fastening arm 216 is inserted between front plate 254 and back plate 252. A pair of open-ended slots 258 are formed in the front plate 254 to leave a central section 260 which is connected only at one end to the rest of body 106. A triangular reinforcing gusset 262 projects orthogonally from the central section 260 and bridges from there to a manually operable tab or lever, to be described below.

FIG. 3 is an isometric view from a direction opposite from that shown in FIG. 2, and better shows the tabs or levers 264 which project horizontally from respective central sections 260. It is preferred that the tabs 264 occupy vertical planes. The levers 264 are depressable in a second direction which, in the illustrated embodiment, happens to be parallel to the direction of translation 218. The crosspiece 122 of the body 106 terminates at either end thereof with a guard 266 having an orifice 268 into which tab 264 can be depressed. The guard 266 is disposed in a plane which is orthogonal to the direction of actuation of lever 264. Guard 266 helps guard against inadvertent actuation of the tab or lever 264, and also provides an anchor or leverage or purchase point for a thumb or finger when a user manually presses in lever 264. Each tab or lever may terminate in an enlargement 300 which provides more surface area for a thumb or finger to engage. FIG. 3 also demonstrates a preferred feature in which stationary structural member or plate 240 and back plate 250 are actually the same structure.

FIG. 4 is an isometric view similar to FIG. 2, but showing the mobile gripping members 120 completely inserted into channels 228 to closed or fastening positions. FIG. 4 shows the spatial relationship between article supporting fingers 210, 232 when the finger pairs 120, 200 are in a closed position relative to each other.

Figure 5:
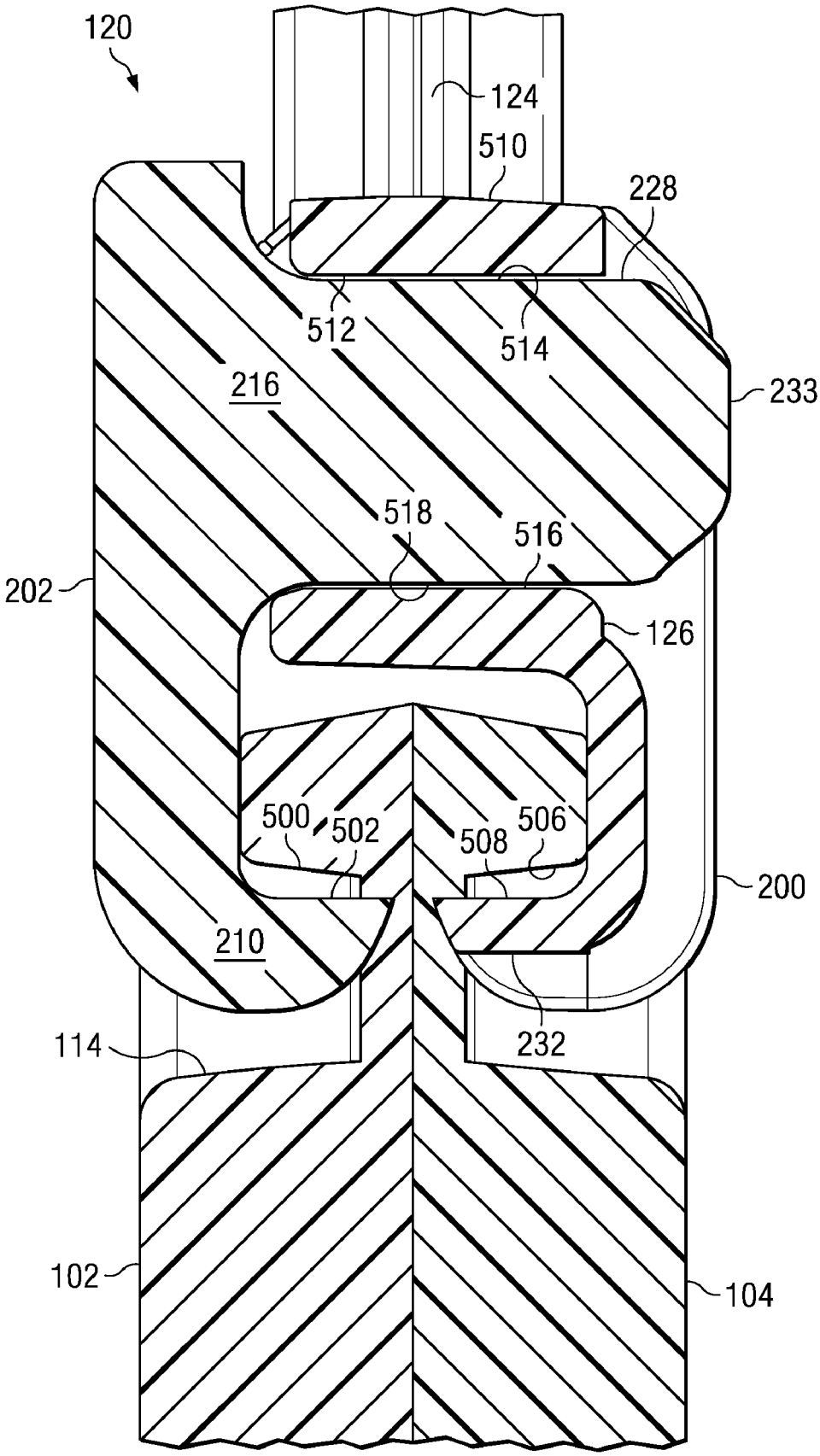
FIG. 5 is a sectional detail taken substantially along Line 5-5 of FIG. 1.

FIG. 5 is a detail showing the relationship of mobile gripping member 120 when the fastening arm 216 thereof has been inserted all of the way into orifice or channel 228. Finger 210 has been inserted all the way into indentation 114 of the mat or other suspended article 114. While not shown here, in practice a surface 500 of the mat indentation 114 will rest upon a top surface 502 of the article support finger 210. Similarly, article support finger 232 is now disposed inside of a preformed indentation 504 built into mat 104 for the purpose of being suspended by hanger 100. Although not shown here, in practice a surface 506 of the indentation 504 will rest upon a top surface 508 of the stationary article support finger 232. Fingers 210, 232 thereby capture between them two back-to-back mats 102, 104.

Where the suspended article(s) have some elastic give to them, as e.g. rubber vehicle floor mats are because they are fabricated of an elastomer, it is preferred that when the fingers 120, 200 are in a completely closed or latched position, they hold the article(s) 102, 104 in a compressed condition. Then, when the user presses lever 264, the mobile member 120 will "pop" outward from stationary member 200 in parallel to direction 218. The "pop" motion of the mobile member 120 will visually identify the member 120 to the user as the component which should be withdrawn from the remainder of hanger 100 in order to remove the article(s) 102, 104 from the hanger 100. The "pop" motion also automatically starts this withdrawing action and makes it easier for a user to complete it.

The channel or orifice 228 associated with stationary gripping member 200 is defined in part by a top frame member 510 and crosspiece frame member 126. A bottom surface 512 of the top frame member 510 adjoins a top surface 514 of the mobile gripping member fastening arm 216. A top surface 516 of the plate 126 supports a bottom surface 518 of the fastening arm 216.

Figure 6:
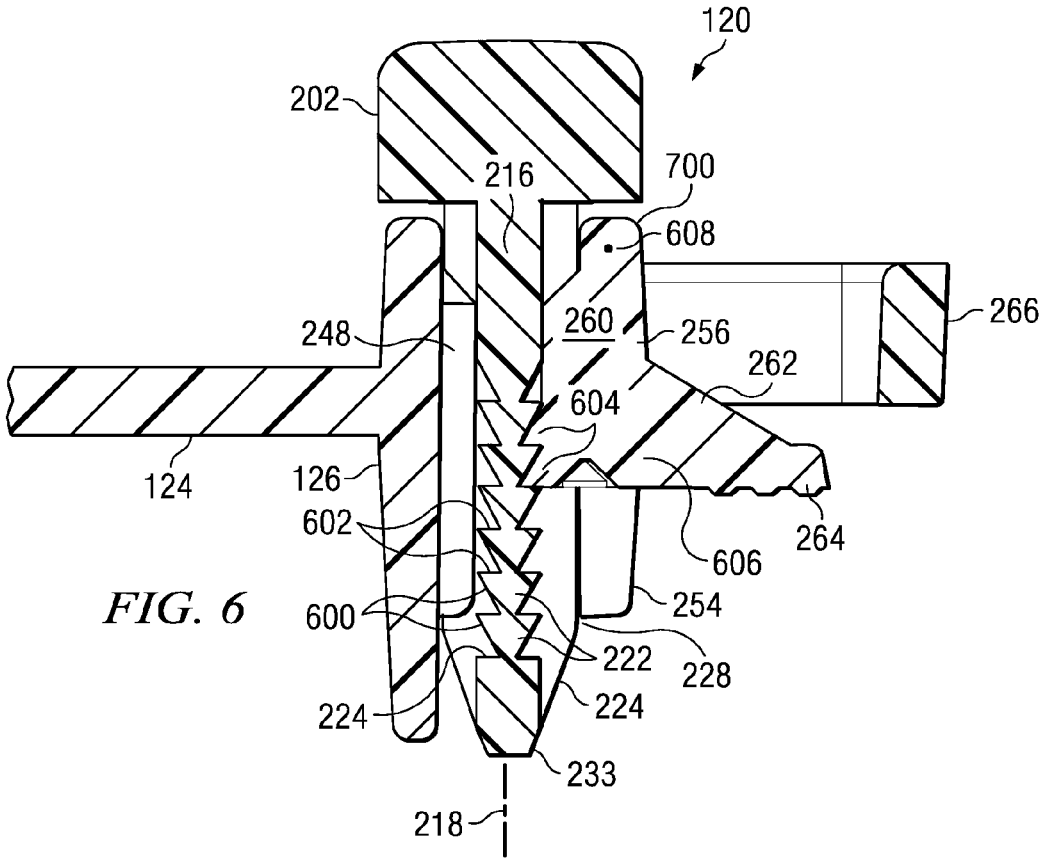
FIG. 6 is a sectional detail taken substantially along Line 6-6 of FIG. 4.

FIG. 6 shows a sectional view of a mobile gripping member 120 completely inserted into a respective channel or orifice 228 to a closed, fastened or detented position therein. As shown, it is preferred that the teeth 222 have a "shark tooth"

design, where each of the leading surfaces 600 is an inclined plane, and each of the trailing surfaces 602 takes a steeper angle to the direction of translation or insertion 218. This will make withdrawal of the mobile gripping member 120 from the orifice 228 much more difficult than its insertion.

At least one, and preferably two, teeth 604 of a pawl 606 engage with two teeth 222 of the fastening arm 216 to prevent the mobile gripping member 120 from being withdrawn. Also apparent is that rails 224 and teeth 222 have been formed on both sides of fastening arm 216, even where only one side thereof engages with pawl 606. This intentional duplication permits the same mobile gripping member 120 to be used with either channel 228, the latter of which are formed in mirror image to each other.

Figure 7:
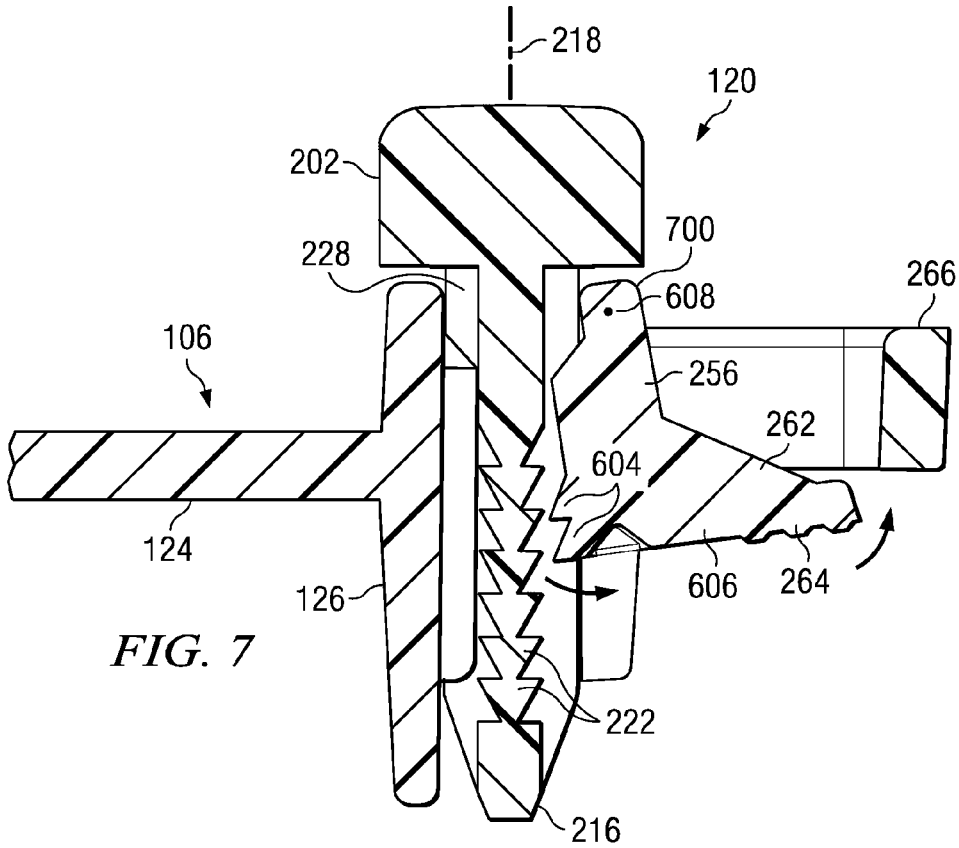
FIG. 7 is a sectional detail of the same structure shown in FIG. 6, showing deflection of a pawl and lever to a position at which a mobile gripping member may be released.

FIG. 7 is a detail of the same region as that shown in FIG. 6, but illustrates the deformation of pawl 606 when tab 264 is pushed inward (in this FIGURE, upward) with sufficient force. The slots 258 (FIG. 3) turn a remaining, unslotted portion 700 of front plate 256 into a torsion bar. Because of the triangular gusset 262 and the slots 258 (FIG. 3), the combined pawl/lever structure 264/606 will rotate as a unit approximately around a pivot 608 in portion 700 until teeth 604 have been rotated up and out of the way of fastening arm teeth 222. In this condition, the mobile gripping member 120 may be withdrawn from channel 228 (in this FIGURE, upwardly) and the hanger 100 detached from the article(s) it is suspending.

Figure 8:
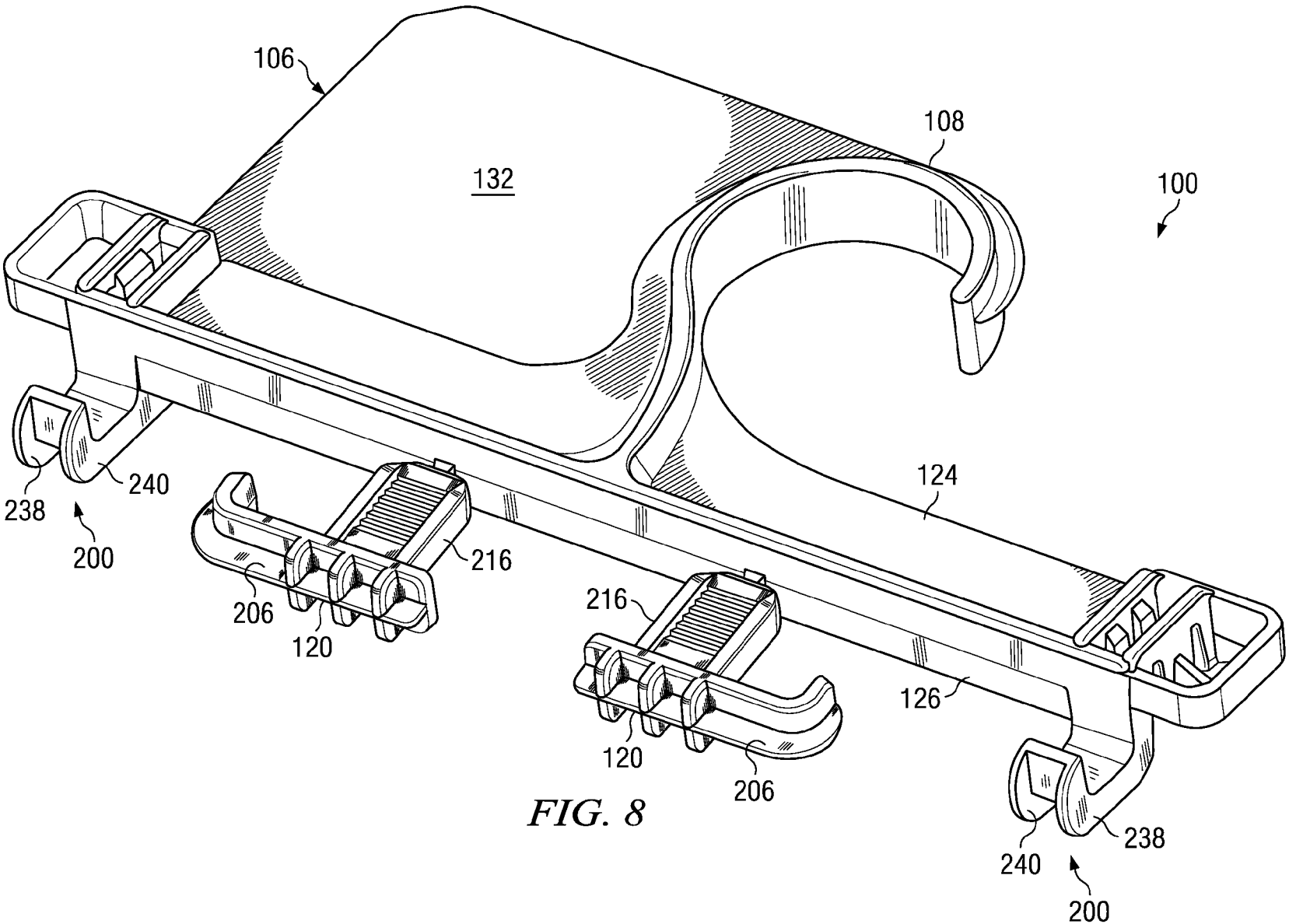
FIG. 8 is an isometric view of the hanger shown in FIG. 1, after injection-molding but before detachment of the mobile gripping members.
Figure 9:
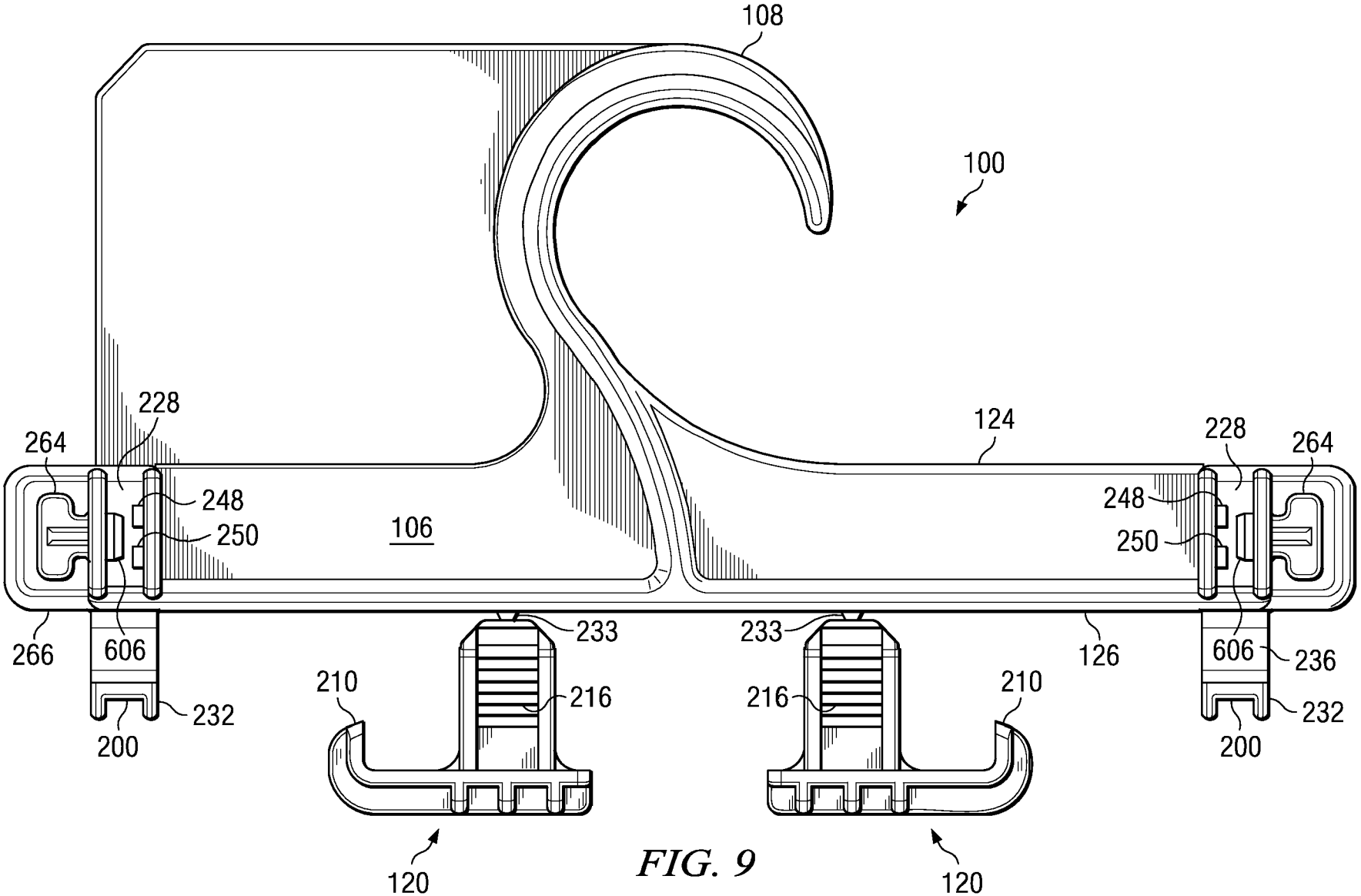
FIG. 9 is a plan view of the hanger in the condition it is shown in FIG. 8.

FIG. 8 is an isometric view of the hanger 100 as it appears out of the mold and prior to use. Preferably, the mobile fingers 120 are molded as a unit with hanger body 106. In general, it is preferred that the depth of this mold (in a direction orthogonal to plate 124) be minimized. This is aided by specifying vertical ratchet surfaces on the fastening arms 216, as this orientation will produce a flatter profile of the entire mold. A single reinforcing plate 206 on the mobile gripping members 120 is preferably chosen instead of two such plates or processes 238, 240 (as seen in the stationary gripping members 200) for ease in molding; this obviates any need for a slide action in the mold. The noses 233 of the fastening arms 216 make convenient points to detach the mobile gripping members 120 from the hanger body 106. FIG. 9 is a plan view of the hanger 100 in this condition.

The present invention extends to embodiments other than those illustrated. As mentioned, the number of pairs of gripping members 120, 200 can be selected as one or three or more, depending on the nature of the article to be suspended. Some of article supporting fingers 210, 232 may be omitted, as where only a single article with only two indentations is to be supported, the other gripping member then having only an opposed straight section to serve as a backing against which a back of the suspended article is pressed.

The illustrated fastening arms 216 take a vertical orientation, but the ratcheting or detenting surfaces thereof alternatively could be horizontal or at some other angle to the vertical. While fastening arms have been shown as integral with the mobile gripping members and the pawls 606 and channels 228 are shown associated with the stationary gripping members, these structures could be reversed, such that the mobile gripping members have the channels and pawls and the stationary gripping members have horizontally projecting fastening arms. While it is preferred that the pawl 606 have two teeth 604 and the fastening arms 216 have multiple teeth 222, minimally all that is required is one detent on the fastening arm which would cooperate with one such pawl detent, tooth, catch or latch in the channel 228 to define and retain a closed or fastened position. And while the present invention has particular application to vehicle floor mats, it also has application to any other article, particularly a heavy one, which may be advantageously displayed or stored using a hanger.

In summary, a novel article hanger has been shown and described which captures the article(s) to be suspended by inserting mobile gripping members or claws along channels to close with respective stationary gripping members or claws. Provision of teeth on fastening arms in cooperation with a pawl prevents inadvertent detachment of the hanger from the article.

While illustrated embodiments of the present invention have been described and illustrated in the appended drawings, the present invention is not limited thereto but only by the scope and spirit of the appended claims.

I claim:

1. A hanger for suspending at least one article, comprising:

a body;

at least first and second pairs of opposed downwardly depending article gripping members, one each of said pairs being a stationary article gripping member affixed to the body to downwardly depend therefrom;

the other of each of said pairs of article gripping members being a mobile article gripping member translatable in a first direction at an angle to the vertical and toward the stationary gripping member to fasten the article therebetween;

the first pair of article gripping members being displaced from the second pair of article gripping members in a second direction at an angle to the first direction and at an angle to the vertical;

in each pair, at least one of the mobile gripping member and the stationary gripping member having an article support finger extending in parallel to the first direction toward the other gripping member;

in each pair, the mobile article gripping member having a fastening arm extending in parallel to the first direction toward the stationary gripping member, the fastening arm having formed therein a plurality of detenting teeth spaced apart from each other in the first direction; and the in each pair, stationary article gripping member having an arm-receiving channel and a movable pawl for engaging at least a selected one of the detenting teeth on said fastening arm, a lever operatively connected to the pawl for selectively disengaging the pawl from the detenting teeth, the detenting teeth, when engaged with the pawl, disposed in a vertical plane which is at an angle to the second direction.

2. The hanger of claim 1, wherein the stationary gripping member of each pair, is integrally molded with the body of the hanger.

3. The hanger of claim 1, wherein the body of the hanger has a width and height which are much greater than a depth thereof, the body of the hanger and the mobile gripping member injection-molded of plastic in a single mold, the mobile gripping member detached after molding for fastening the hanger to the article.

4. The hanger of claim 1, wherein both the stationary gripping member and the mobile gripping member of each pair, have article support fingers extending in parallel to the first direction, the article support fingers extending toward each other.

5. The hanger of claim 1, wherein the pawl engages at least two teeth on the fastening arm.

6. A hanger for suspending an article, comprising:

a body;

at least one pair of opposed downwardly depending article gripping members, one of said pair being a stationary article gripping member affixed to the body to downwardly depend therefrom;

the other of said pair of article gripping members being a separate mobile article gripping member translatable in a first direction at an angle to the vertical and toward the stationary gripping member to fasten the article therebetween;

at least one of the mobile gripping member and the stationary gripping member having an article support finger extending in the first direction toward the other gripping member;

the mobile article gripping member having a fastening arm extending parallel to the first direction toward the stationary gripping member, the fastening arm having formed thereon at least one detent; and the stationary article gripping member having an arm-receiving channel and a movable latch for engaging the detent on said fastening arm to fasten the article between the two gripping members, a lever operatively connected to the latch for selectively disengaging the latch from the detent in order to release the article from the hanger, the lever disposed on an end of the body and pressable by a thumb or finger of the human hand in a second direction to disengage the latch from the detent on the fastening arm, a guard formed on the body to extend around the lever in a plane at an angle to the second direction, the guard protecting the lever from inadvertent actuation and affording an anchor or purchase point to the human hand in operating the lever.

7. The hanger of claim 6, and further comprising a second pair of opposed, downwardly depending gripping members for fastening to the suspended article at a second location spaced from a location at which said at least one pair of gripping members fastens to the article.

8. The hanger of claim 6, wherein the detent of the fastening arm is formed in a surface which in use is vertically oriented.

9. A hanger for suspending an article, comprising:

a body;

at least one pair of opposed downwardly depending article gripping members, one of said pair being a stationary article gripping member affixed to the body to downwardly depend therefrom;

the other of said pair of article gripping members being a mobile article gripping member linearly translatable in a first direction at an angle to the vertical and toward the stationary gripping member to fasten the article therebetween;

at least one of the mobile gripping member and the stationary gripping member having an article support finger extending in the first direction toward the other gripping member;

the mobile article gripping member having a fastening arm extending in parallel to the first direction toward the stationary gripping member, the fastening arm including a vertically disposed ratchet plate having a plurality of detents formed therein, the ratchet plate having a thickness in a second direction orthogonal to the first direction and to the vertical, the ratchet plate of the fastening arm extending in the vertical direction from a top rail of the fastening arm to a bottom rail of the fastening arm, respective thicknesses of the top and bottom rails of the fastening arm in the second direction being greater than the thickness of the ratchet plate; and the stationary article gripping member having an arm-receiving channel, an upper portion of the channel slideably receiving the top rail of the fastening arm of the mobile article gripping member, a lower portion of the channel slideably receiving the bottom rail of the fastening arm of the mobile article gripping member, a movable latch disposed between the upper and lower portions of the channel for engaging at least one of the detents on said ratchet plate, a lever operatively connected to the latch for selectively disengaging the latch from the detent in order to release the article from the hanger.

10. The hanger of claim 9, and further comprising a second pair of opposed, downwardly depending gripping members for fastening to the suspended article at a second location spaced from a location at which said at least one pair of gripping members fastens to the article.

11. The hanger of claim 9, wherein the stationary gripping member is integrally molded with the body of the hanger.

12. The hanger of claim 9, wherein both the stationary gripping member and the mobile gripping member have article support fingers extending in parallel to the first direction, the article support fingers extending toward each other.

13. The hanger of claim 9, wherein the latch engages at least two detents on the ratchet plate of the fastening arm.

* * * * *